US010135187B2

(12) United States Patent
Fukumoto

(10) Patent No.: US 10,135,187 B2
(45) Date of Patent: Nov. 20, 2018

(54) ELECTRICAL CONNECTOR ASSEMBLY AND ELECTRICAL CONNECTOR ASSEMBLY PAIR

(71) Applicant: DAI-ICHI SEIKO CO., LTD., Kyoto-shi, Kyoto (JP)

(72) Inventor: Yasuaki Fukumoto, Machida (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/843,741

(22) Filed: Dec. 15, 2017

(65) Prior Publication Data

US 2018/0183182 A1 Jun. 28, 2018

(30) Foreign Application Priority Data

Dec. 28, 2016 (JP) ..... 2016-255965

(51) Int. Cl.
*H01R 13/635* (2006.01)
*H01R 13/627* (2006.01)
*H01R 24/86* (2011.01)

(52) U.S. Cl.
CPC ..... *H01R 13/635* (2013.01); *H01R 13/6275* (2013.01); *H01R 13/6277* (2013.01); *H01R 24/86* (2013.01)

(58) Field of Classification Search
CPC ..... H01R 13/635; H01R 13/6275
(Continued)

(56) References Cited

U.S. PATENT DOCUMENTS 6,254,400 B1 7/2001 Yodogawa
6,267,612 B1 7/2001 Arcykiewicz et al.
(Continued)

FOREIGN PATENT DOCUMENTS

EP 2978079 A1 1/2016
JP 05-057775 U 7/1993
(Continued)

OTHER PUBLICATIONS

Extended European Search Report (Application No./Patent No. 17208434.5); dated Mar. 15, 2018.
(Continued)

*Primary Examiner* — Tulsidas C Patel
*Assistant Examiner* — Travis Chambers
(74) *Attorney, Agent, or Firm* — Howard & Howard Attorneys PLLC

(57) ABSTRACT

A plug connector includes a locking member of the plug having extension bases fixed to a second plug housing and cantilever extensions extending from the respective extension bases in the direction of a plugging operation. The cantilever extensions each have an engaged hole to receive corresponding one of protrusions protruded from a receptacle housing. The cantilever extensions are each resilient enough to bend in the protruding direction of the corresponding protrusion. A releasing member allows the protrusions to relatively move in the directions of plugging and unplugging operations. When the releasing member is slid relative to the second plug housing, the releasing member bends the cantilever extensions in the protruding directions of the respective protrusions and thereby release engagement of the protrusions with the engaged holes.

7 Claims, 12 Drawing Sheets

(58) Field of Classification Search
USPC ..... 439/357, 352, 358
See application file for complete search history.

(56) References Cited

U.S. PATENT DOCUMENTS

| | | | | |
|---|---|---|---|---|
| 7,175,464 | B2 * | 2/2007 | Ferderer | H01R 13/6272 439/352 |
| 7,632,130 | B2 * | 12/2009 | Sami | H01R 13/6395 439/352 |
| 8,257,105 | B2 * | 9/2012 | Schmidt | H01R 13/508 439/352 |
| 2010/0304598 | A1 * | 12/2010 | Kari | H01R 13/6277 439/352 |
| 2012/0252282 | A1 * | 10/2012 | Maki | H01R 13/639 439/784 |

FOREIGN PATENT DOCUMENTS

| | | | |
|---|---|---|---|
| JP | 2001-035594 | A | 2/2001 |
| JP | 2001-214993 | A | 8/2001 |
| JP | 3296794 | B | 4/2002 |
| JP | 2010-092689 | A | 4/2010 |
| JP | 2015-018741 | A | 1/2015 |
| JP | 2015-018742 | A | 1/2015 |

OTHER PUBLICATIONS

Notification of Reason for Refusal (JP Patent Application No. 2016-255965); dated Sep. 14, 2018; Includes English Translation.

* cited by examiner

ELECTRICAL CONNECTOR ASSEMBLY AND ELECTRICAL CONNECTOR ASSEMBLY PAIR

CROSS-REFERENCE TO RELATED APPLICATION

This application claims the benefit of Japanese Patent Application No. 2016-255965, filed on Dec. 28, 2016, the entire disclosure of which is incorporated by reference herein.

FIELD

This application relates to an electrical connector and an electrical connector pair.

BACKGROUND

Unexamined Japanese Patent Application Kokai Publication No. 2015-18742 discloses a traditional plug connector that can be plugged into and unplugged from a receptacle connector having protrusions through a pushing operation and a pulling operation. This plug connector includes an insulating housing, a locking shell fixed to the housing, and an outer housing slidably connected to the housing. The locking shell engages with the protrusions of the receptacle connector. This engagement of the locking shell with the protrusions is released when a user slides the outer housing apart from the receptacle connector.

The above-mentioned pushing operation indicates an operation of plugging the plug connector into the receptacle connector to engage the locking shell with the protrusions of the receptacle connector. The engagement of the locking shell with the protrusions prevents the plug connector from being unplugged from the receptacle connector. The above-mentioned pulling operation indicates an operation of sliding the outer housing apart from the receptacle connector to release the engagement of the locking shell with the protrusions. This operation allows the plug connector to be unplugged from the receptacle connector.

The locking shell has portions having hook-shaped and expanding cross sections to engage with the respective protrusions. The plug connector therefore requires a space large enough to accommodate such a locking shell. This requirement inhibits the development of a smaller plug connector.

In addition, the plug connector requires an assembly of members to prevent the outer housing from slipping out of the housing in addition to the locking shell. This requirement also inhibits the development of a smaller plug connector.

An objective of the present disclosure is to provide an electrical connector and an electrical connector pair reduced in size in comparison to traditional products.

SUMMARY

An electrical connector according to a first aspect of the present disclosure, in order to achieve the above objective, includes: a housing having insulating properties and shaped so as to be plugged into and unplugged from a mating housing included in a mating electrical connector; contacts retained in the housing, the contacts being electrically connected to respective mating contacts retained in the mating housing of the mating electrical connector while the housing is being plugged in the mating housing; a locking member including: extension bases fixed to the housing; and cantilever extensions extending from the respective extension bases in a direction of a plugging operation, the cantilever extensions each having an engaged hole to receive corresponding one of protrusions protruded from the mating housing and configured to engage with the respective engaged holes upon completion of the plugging operation, the cantilever extensions being each resilient enough to bend in the protruding direction of the corresponding protrusion; and a releasing member coupled to the housing such that the releasing member is slidable in the direction of the plugging operation and a direction of an unplugging operation, the releasing member being configured to allow the protrusions to relatively move in the directions of the plugging and unplugging operations, the releasing member being configured to bend the cantilever extensions in the protruding directions of the respective protrusions and thereby release engagement of the protrusions with the engaged holes when the releasing member is slid relative to the housing.

The locking member may further include a blocker integrated with the extension bases and fixed to the housing while extending along the outer circumference of the housing in a virtual plane orthogonal to the directions of the plugging and unplugging operations, the blocker being configured to prevent the releasing member from slipping out of the housing in the direction of the plugging operation at blocking portions of the blocker other than portions adjoining the respective extension bases.

The cantilever extensions may urge the releasing member in the direction of the plugging operation. The blocker may prevent the releasing member urged by the cantilever extensions in the direction of the plugging operation from slipping out in the direction of the plugging operation.

The cantilever extensions may each have an inclined portion at the free end of the cantilever extension, the inclined portion being inclined such that the inclined portion recedes from the housing in the direction of the plugging operation. The releasing member may include wedges to come into contact with the respective inclined portions, the wedges being each inclined such that the wedge approaches the housing in the direction of the unplugging operation. The cantilever extensions may each urge the releasing member in the direction of the plugging operation by applying a resilient restoring force in a direction approaching the housing to the corresponding wedge via the inclined portion. When each of the wedges is slid in the direction of the unplugging operation against the resilient restoring force, the wedge may push the corresponding inclined portion in a direction receding from the housing and thereby bend the cantilever extension in the protruding direction of the corresponding protrusion.

An electrical connector according to a second aspect of the present disclosure, in order to achieve the above objective, includes: a housing having insulating properties and shaped so as to be plugged into and unplugged from a mating housing included in a mating electrical connector; contacts retained in the housing, the contacts being electrically connected to respective mating contacts retained in the mating housing of the mating electrical connector while the housing is being plugged in the mating housing; a locking member including: extension bases fixed to the housing; and cantilever extensions extending from the respective extension bases in a direction of a plugging operation, the cantilever extensions each having an engaged portion to receive corresponding one of engaging portions disposed in the mating housing and configured to engage with the respective engaged portions upon completion of the plugging operation, the cantilever extensions being each resilient enough to bend in a direction receding from the housing; and a releasing member coupled to the housing such that the releasing member is slidable in the direction of the plugging operation and a direction of an unplugging operation, the releasing member being configured to allow the engaging portions to relatively move in the directions of the plugging and unplugging operations, the releasing member being configured to bend the cantilever extensions in the directions receding from the housing and thereby release engagement of the engaging portions with the engaged portions when the releasing member is slid relative to the housing. The locking member further includes a blocker integrated with the extension bases and fixed to the housing while extending along the outer circumference of the housing in a virtual plane orthogonal to the directions of the plugging and unplugging operations, the blocker being configured to prevent the releasing member from slipping out of the housing in the direction of the plugging operation at blocking portions of the blocker other than portions adjoining the respective extension bases.

An electrical connector pair according to a third aspect of the present disclosure includes: the electrical connector according to the above first aspect; and the mating electrical connector.

The mating electrical connector may include an installing member mounted around the mating housing in a virtual plane orthogonal to the directions of the plugging and unplugging operations, the protrusions being disposed on the installing member.

The protrusions may be each inclined such that the height of the protrusion increases along the direction of the plugging operation.

In the electrical connector according to the first aspect of the present disclosure, the engaged holes of the cantilever extensions receive the respective protrusions of the mating electrical connector, so that the electrical connector is maintained to be plugged in the mating electrical connector. The installation of the cantilever extensions having the engaged holes requires a smaller space than the space required for the installation of a member having a hook-shaped and expanding cross section in the traditional electrical connector. The configuration can therefore reduce the size of the electrical connector in comparison to the traditional electrical connector.

In the electrical connector according to the second aspect of the present disclosure, the locking member not only engages with the mating electrical connector but also prevents the releasing member from slipping out of the housing. This configuration can reduce the number of components, thereby reducing the size of the electrical connector in comparison to the traditional electrical connector.

BRIEF DESCRIPTION OF THE DRAWINGS

A more complete understanding of this application can be obtained when the following detailed description is considered in conjunction with the following drawings, in which.

DETAILED DESCRIPTION

Figure 1A:
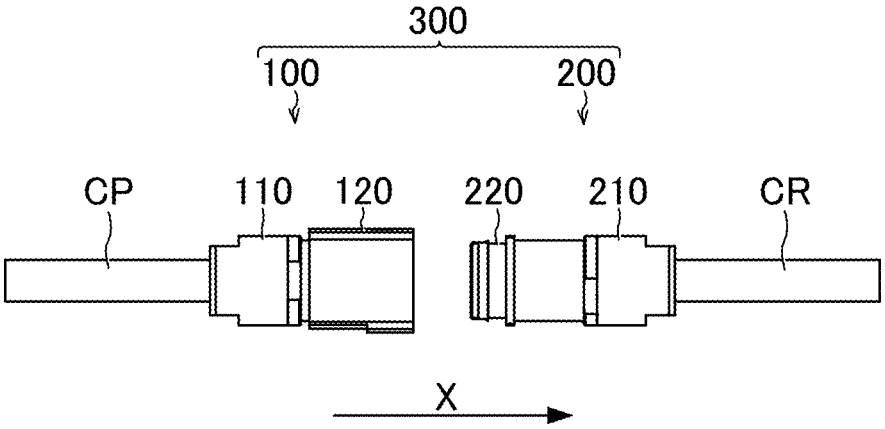
FIG. 1A is a plan view of an electrical connector pair.

An electrical connector pair according to an embodiment of the present disclosure will now be described with reference to the following drawings. In the drawings, the identical or corresponding components are provided with the same reference signs.

With reference to FIG. 1A, an electrical connector pair 300 according to the embodiment is used to electrically connect a cable CP to a cable CR, and includes a plug connector 100 (serving as an electrical connector) mounted on the end of the cable CP and a receptacle connector 200 (serving as a mating electrical connector) mounted on the end of the other cable CR.

The plug connector 100 can be plugged into and unplugged from the receptacle connector 200. When the plug connector 100 is plugged into the receptacle connector 200, the connectors 100 and 200 engage with each other, so that the cable CP is electrically connected to the cable CR.

In order to facilitate an understanding of the following description, an X axis is defined such that the positive X-axis direction indicates the direction of plugging the plug connector 100 into the receptacle connector 200 whereas the negative X-axis direction indicates the direction of unplugging the plug connector 100 from the receptacle connector 200. The X axis is represented by an arrow pointing to the positive X-axis direction in each drawing.

The configuration of the receptacle connector 200 will now be described.

The receptacle connector 200 includes a clamping member 210 fixed to the end of the cable CR and an insulating receptacle housing 220 (serving as a mating housing) coupled to the end of the clamping member 210 adjacent to the plug connector 100.

Figure 1B:
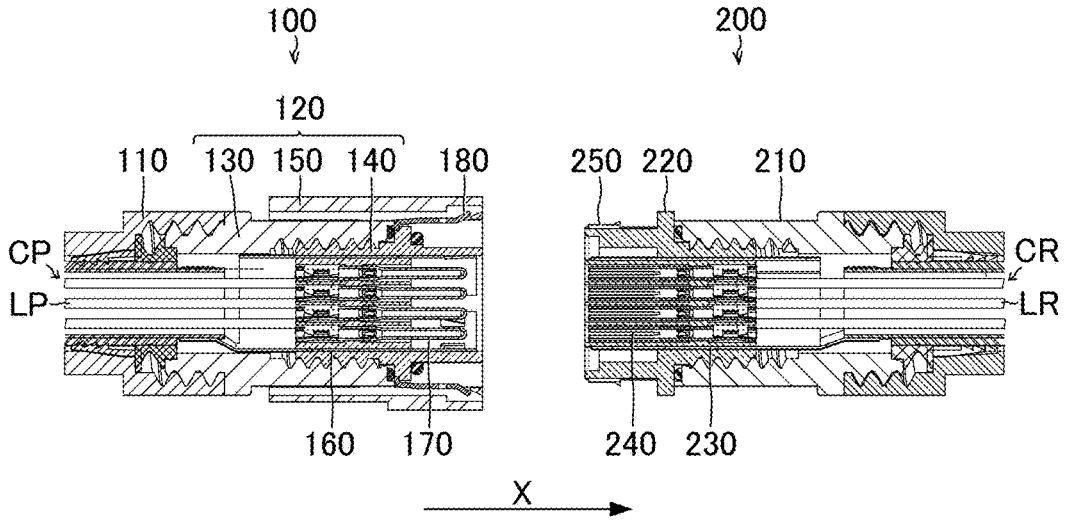
FIG. 1B is a cross-sectional view of the main part of the electrical connector pair taken along the line AA-AA of FIG. 5.

With reference to FIG. 1B, the receptacle housing 220 is screwed into the clamping member 210. The receptacle housing 220 accommodates a metal shield member 230 having a substantially hollow cylindrical shape and receptacle contacts 240 (serving as mating contacts) disposed inside the shield member 230. The receptacle contacts 240 extend in parallel to the X axis and are electrically connected to electric wires LR included in the cable CR.

Figure 2:
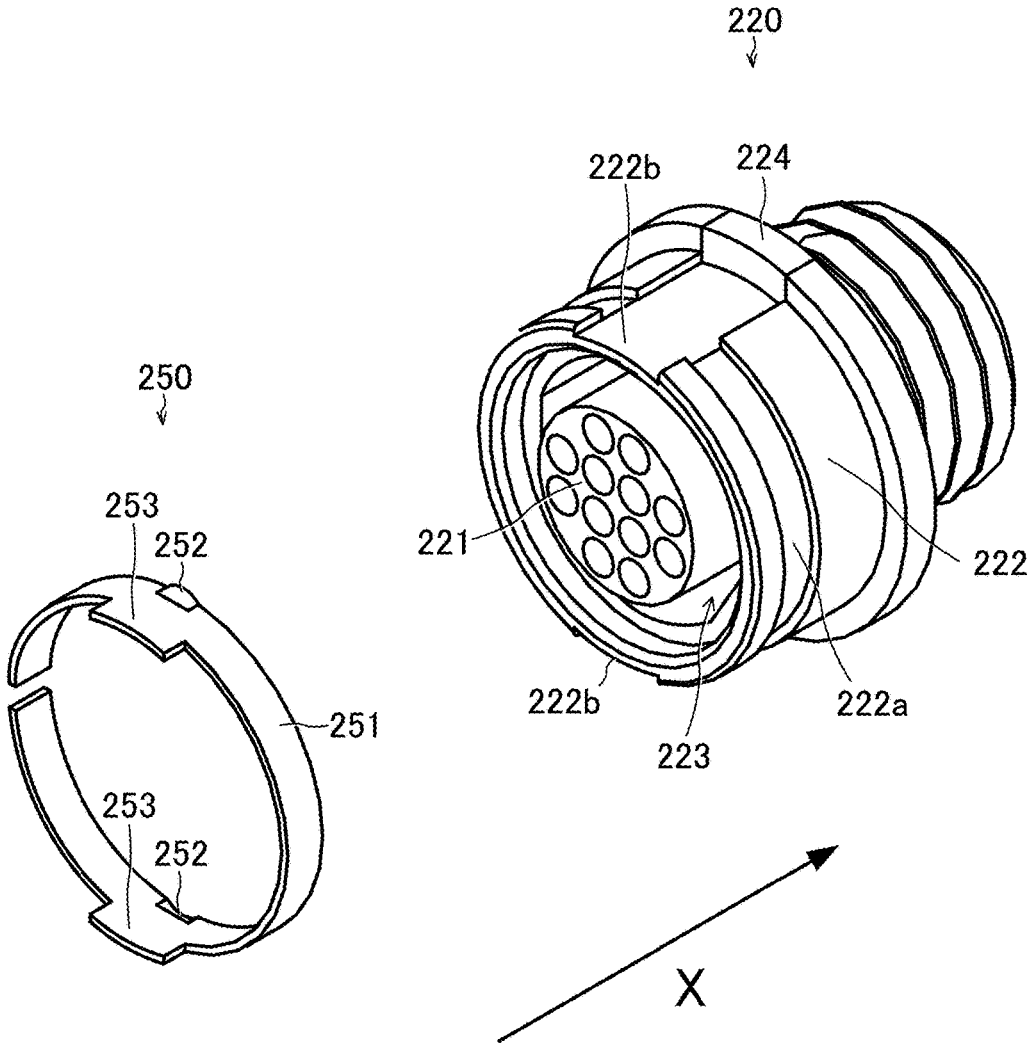
FIG. 2 is an exploded perspective view of the main part of a receptacle connector.

With reference to FIG. 2, the receptacle housing 220 includes a retainer 221 into which the receptacle contacts 240 are squeezed, and an outer cylinder 222 surrounding the retainer 221 about the virtual central axis parallel to the X axis. The retainer 221 retains the receptacle contacts 240 such that the individual receptacle contacts 240 are insulated from each other.

The retainer 221 and the outer cylinder 222 define a gap 223 therebetween. In the receptacle connector 200 receiving the plug connector 100, the outer cylinder 222 resides in the plug connector 100.

The outer cylinder 222 has a flange 224 protruding from the end of the outer cylinder 222 adjacent to the clamping member 210 illustrated in FIG. 1B. In the receptacle connector 200 receiving the plug connector 100, the plug connector 100 abuts on the flange 224.

The outer circumference of the outer cylinder 222 has a circumferential groove 222*a* extending in the circumferential direction about the virtual central axis parallel to the X axis and intersecting grooves 222*b* extending in parallel to the X axis and intersecting the circumferential groove 222*a*. The intersecting grooves 222*b* are disposed in different positions spaced from each other in the circumferential direction about the virtual central axis parallel to the X axis, in specific, two positions spaced at an interval of 180° in the circumferential direction.

The receptacle housing 220 is provided with a metal locking member 250 of the receptacle (serving as an installing member) mounted around the outer cylinder 222 in a virtual plane orthogonal to the X axis. The locking member 250 of the receptacle has a C ring 251 disposed about the virtual central axis parallel to the X axis, protrusions 252 protruding outward from the periphery of the C ring 251 in the radial direction thereof, and extensions 253 extending from the C ring 251 in parallel to the X axis, in specific, in the negative X-axis direction.

The protrusions 252 and the extensions 253 are each disposed in different positions spaced from each other in the circumferential direction about the virtual central axis parallel to the X axis, in specific, two positions spaced at an interval of 180° in the circumferential direction, like the intersecting grooves 222*b* of the outer cylinder 222. Each protrusion 252 and the corresponding extension 253 have centers aligned to the same position in the circumferential direction. The width of each extension 253 in the circumferential direction is larger than that of each protrusion 252.

The locking member 250 of the receptacle is mounted around the receptacle housing 220 while the C ring 251 is being expanded in the radial direction, such that the C ring 251 fits in the circumferential groove 222*a* and the extensions 253 fit in the respective intersecting grooves 222*b*.

The fitting of the C ring 251 in the circumferential groove 222*a* prevents the locking member 250 of the receptacle from moving in the positive or negative X-axis direction relative to the receptacle housing 220. The fitting of the extensions 253 in the intersecting grooves 222*b* prevents the locking member 250 of the receptacle from moving in the circumferential direction about the virtual central axis parallel to the X axis relative to the receptacle housing 220.

It should be noted that FIG. 1B illustrates the locking member 250 of the receptacle mounted around the receptacle housing 220.

The configuration of the plug connector 100 will now be described.

Referring back to FIG. 1A, the plug connector 100 includes a clamping member 110 fixed to the end of the cable CP and a housing structure 120 coupled to the end of the clamping member 110 adjacent to the receptacle connector 200.

With reference to FIG. 1B, the housing structure 120 includes an insulating first plug housing 130 screwed into the end of the clamping member 110 adjacent to the receptacle connector 200, an insulating second plug housing 140 screwed into the end of the first plug housing 130 adjacent to the receptacle connector 200, and a releasing member 150 having a substantially hollow cylindrical shape and surrounding the first plug housing 130 and the second plug housing 140 about the virtual central axis parallel to the X axis.

A locking member 180 of the plug is disposed between the releasing member 150 and the second plug housing 140 and between the second plug housing 140 and the first plug housing 130. The locking member 180 of the plug can engage with the locking member 250 of the receptacle.

The second plug housing 140 accommodates a metal shield member 160 having a substantially hollow cylindrical shape and plug contacts 170 (serving as contacts) disposed inside the shield member 160. The plug contacts 170 extend in parallel to the X axis and are electrically connected to electric wires LP included in the cable CP.

The second plug housing 140 is shaped so as to be plugged into and unplugged from the receptacle housing 220 of the receptacle connector 200.

Figure 1C:
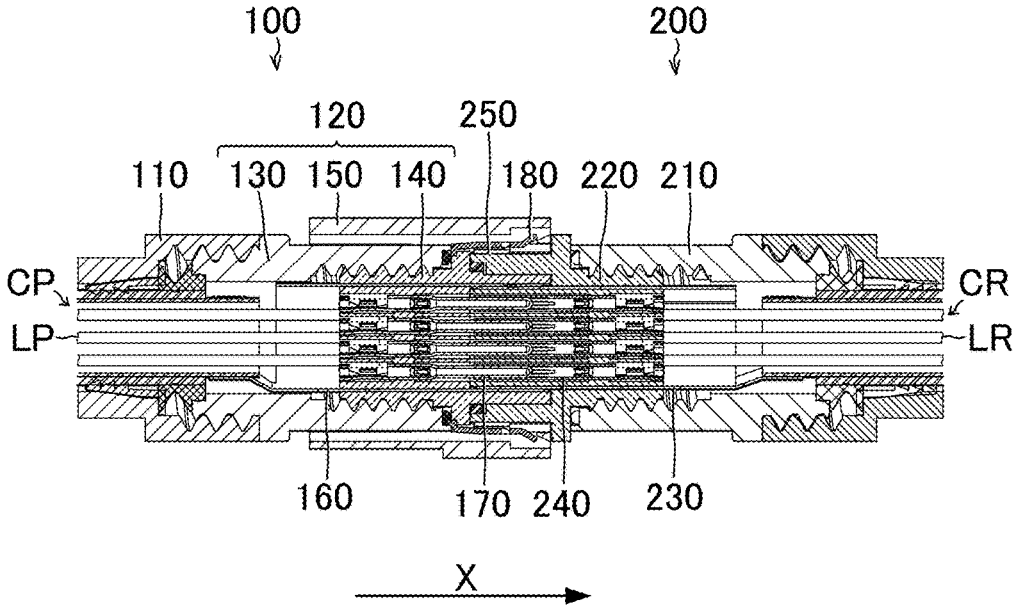
FIG. 1C is a cross-sectional view of the main part of the electrical connector pair taken along the line AA-AA of FIG. 5.

With reference to FIG. 1C, when the second plug housing 140 is plugged into the receptacle housing 220, the plug contacts 170 come into electrical contact with the respective receptacle contacts 240, so that the cable CP is electrically connected to the cable CR. The engagement of the locking member 180 of the plug with the locking member 250 of the receptacle maintains the plugged state illustrated in FIG. 1C.

The engagement of the locking member 180 of the plug with the locking member 250 of the receptacle is released by a sliding movement of the releasing member 150 in the negative X-axis direction. In other words, a user can unplug the plug connector 100 from the receptacle connector 200 while applying a force for sliding the releasing member 150 in the negative X-axis direction.

In this embodiment, the locking member 180 of the plug engaging with the locking member 250 of the receptacle not only prevents the unplugging operation of the plug connector 100, but also guides the sliding movement of the releasing member 150, prevents the releasing member 150 from slipping out in the positive X-axis direction, and urges the releasing member 150 in the positive X-axis direction.

The configuration of the plug connector 100 will now be described in more detail with reference to FIGS. 3 to 7.

Figure 3:
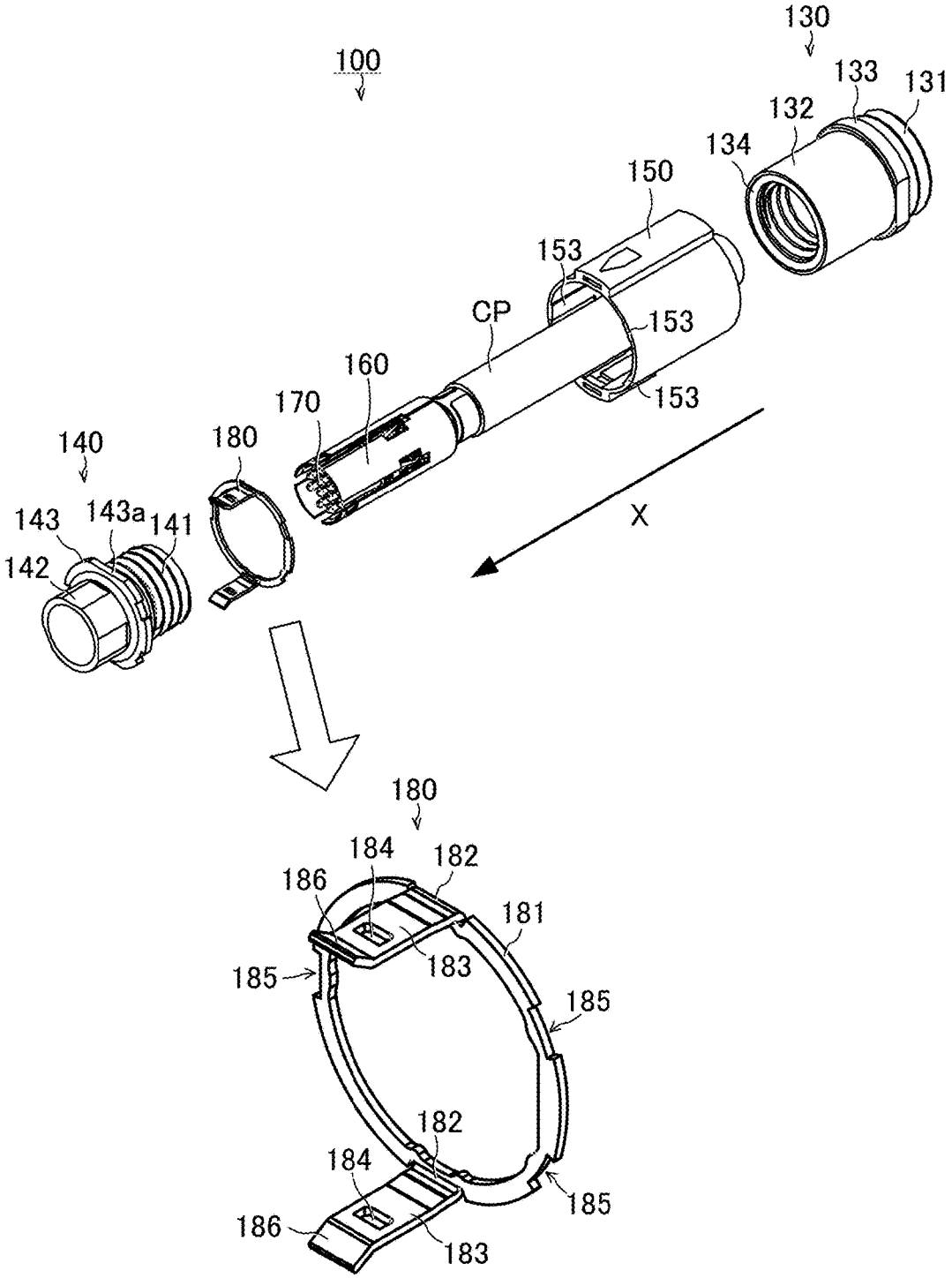
FIG. 3 is an exploded perspective view of the main part of a plug connector.

As illustrated in FIG. 3, the locking member 180 of the plug has a ring 181 disposed about the virtual central axis parallel to the X axis, extension bases 182 disposed at the periphery of the ring 181, and cantilever extensions 183 extending from the respective extension bases 182 in the positive X-axis direction. The ring 181 has a flat shape disposed in a virtual plane orthogonal to the X axis.

The locking member 180 of the plug is fabricated by bending a product punched from a metal plate. That is, the ring 181, the extension bases 182, and the cantilever extensions 183 are integrally formed.

The extension bases 182 and the cantilever extensions 183 are each disposed in different positions spaced from each other in the circumferential direction about the virtual central axis parallel to the X axis, in specific, two positions spaced at an interval of 180° in the circumferential direction, like the protrusions 252 of the locking member 250 of the receptacle illustrated in FIG. 2. In other words, the two cantilever extensions 183 are opposed to each other. The cantilever extensions 183 are resilient enough to bend in the mutually separating directions, that is, outward in the radial direction of the ring 181.

The cantilever extensions 183 each have an engaged hole 184 extending through the thickness of the cantilever extension 183. The above-mentioned engagement of the locking member 250 of the receptacle with the locking member 180 of the plug indicates the engagement of the protrusions 252 illustrated in FIG. 2 with the respective engaged holes 184 in more specific terms. The engagement of the protrusions 252 with the engaged holes 184 prevents the plug connector 100 from being unplugged from the receptacle connector 200.

The first plug housing 130 has a general shape of a substantially hollow cylinder. The first plug housing 130 has a male thread 131 screwed into the clamping member 110 illustrated in FIG. 1B, a female thread 132 receiving the second plug housing 140, and a flange 133 protruding from the boundary between the male thread 131 and the female thread 132. The female thread 132 has thread grooves on the inner circumference.

The second plug housing 140 also has a general shape of a substantially hollow cylinder. The second plug housing 140 has a male thread 141 screwed into the female thread 132 of the first plug housing 130 and an insertable portion 142 to be inserted into the receptacle connector 200. In specific, the insertable portion 142 can be inserted into the gap 223 between the retainer 221 and the outer cylinder 222 illustrated in FIG. 2.

The second plug housing 140 includes a retainer inside the male thread 141 and the insertable portion 142, which is not illustrated in FIG. 3. The shield member 160 surrounding the plug contacts 170 is squeezed into the male thread 141 and the insertable portion 142 in the positive X-axis direction, so that the second plug housing 140 accommodates the shield member 160 and the plug contacts 170. The not-shown retainer retains the plug contacts 170 such that the individual plug contacts 170 are insulated from each other.

The second plug housing 140 further has a flange 143 protruding from the boundary between the male thread 141 and the insertable portion 142. The flange 143 has flat support surfaces 143*a* each defining a straight line as viewed from the front in the direction parallel to the X axis. Although FIG. 3 illustrates only one of the support surfaces 143*a*, the support surfaces 143*a* are disposed in two positions spaced at an interval of 180° in the circumferential direction of the flange 143, like the extension bases 182 and the cantilever extensions 183 of the locking member 180 of the plug.

The second plug housing 140 is screwed into the first plug housing 130 such that the second plug housing 140 and the first plug housing 130 hold the locking member 180 of the plug therebetween. When the male thread 141 is screwed into the female thread 132 through the ring 181 of the locking member 180 of the plug, the ring 181 is held between the flange 143 of the second plug housing 140 and an end face 134 of the first plug housing 130 adjacent to the second plug housing 140.

The locking member 180 of the plug is thus fixed to the first plug housing 130 and the second plug housing 140 by friction, while extending along the outer circumference of the second plug housing 140 in a virtual plane orthogonal to the X axis.

In this configuration, the extension bases 182 of the locking member 180 of the plug are in contact with the respective support surfaces 143*a* of the second plug housing 140. This configuration prevents the locking member 180 of the plug from revolving about the virtual central axis parallel to the X axis relative to the second plug housing 140.

The releasing member 150 also has a general shape of a substantially hollow cylinder. The releasing member 150 surrounds the second plug housing 140, the locking member 180 of the plug, and the first plug housing 130 about the virtual central axis parallel to the X axis, and can freely slide in the positive and negative X-axis directions relative to these three components.

It should be noted that the releasing member 150 surrounds only the female thread 132 of the first plug housing 130 because the end face of the releasing member 150 adjacent to the first plug housing 130 abuts on the flange 133. The releasing member 150 can be slid further than the flange 133 in the positive X-axis direction, and slid in the negative X-axis direction until the releasing member 150 comes into contact with the flange 133.

As described above, the locking member 180 of the plug guides the sliding movement of the releasing member 150 and prevents the releasing member 150 from slipping out in the positive X-axis direction. In order to explain these functions, the structure of the inner circumference of the releasing member 150 will now be described.

Figure 4A:
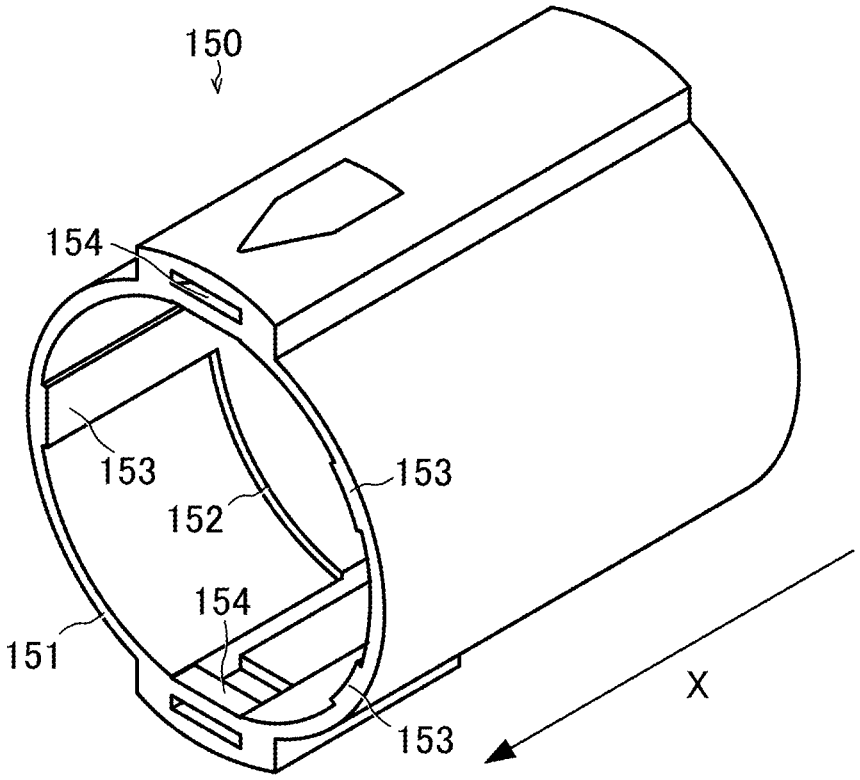
FIG. 4A is a perspective view of a releasing member.

With reference to FIG. 4A, the inner circumference of the releasing member 150 has a step 152 in an intermediate position in the X-axis direction, which defines a difference in the inner diameter of the releasing member 150 such that the portion in the negative X-axis direction has a smaller inner diameter. The step 152 extends in the circumferential direction about the virtual central axis parallel to the X axis. The distance in the X axis direction from the step 152 to an end face 151 of the releasing member 150 adjacent to the second plug housing 140 is equal to or longer than the length of the cantilever extensions 183 illustrated in FIG. 3.

The inner circumference of the releasing member 150 further has linear ridges 153 extending in parallel to the X axis. The linear ridges 153 reside between the step 152 and the end face 151.

Figure 4B:
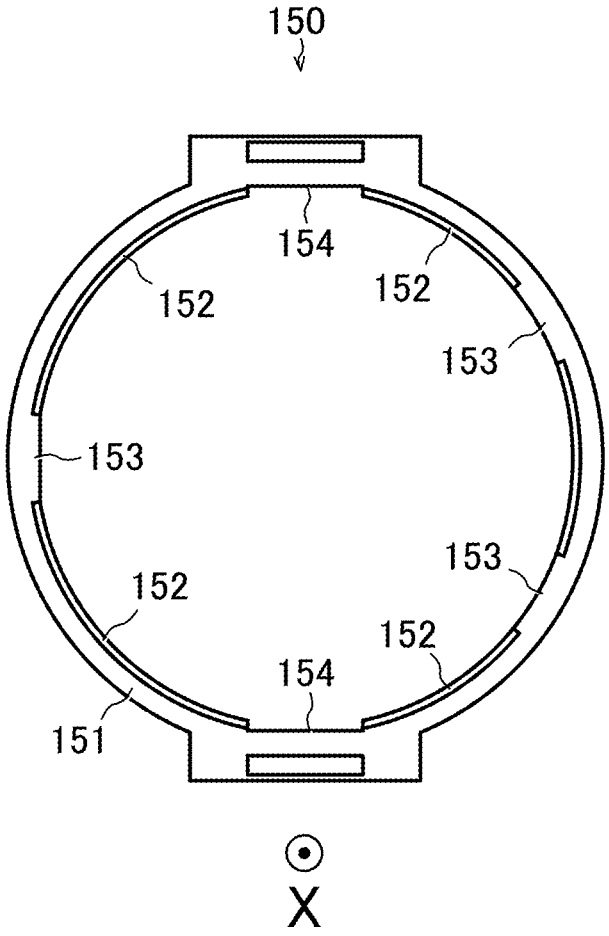
FIG. 4B is a front view of the releasing member.

With reference to FIG. 4B, the inner circumference of the releasing member 150 has a plurality of linear ridges 153, in specific, three linear ridges 153 spaced from each other in the circumferential direction about the virtual central axis parallel to the X axis. The step 152 extends in the circumferential direction between any two linear ridges 153 adjacent to each other in the circumferential direction.

The outer circumference of the locking member 180 of the plug to abut on the inner circumference of the releasing member 150 will now be described with reference to FIG. 5.

Figure 5:
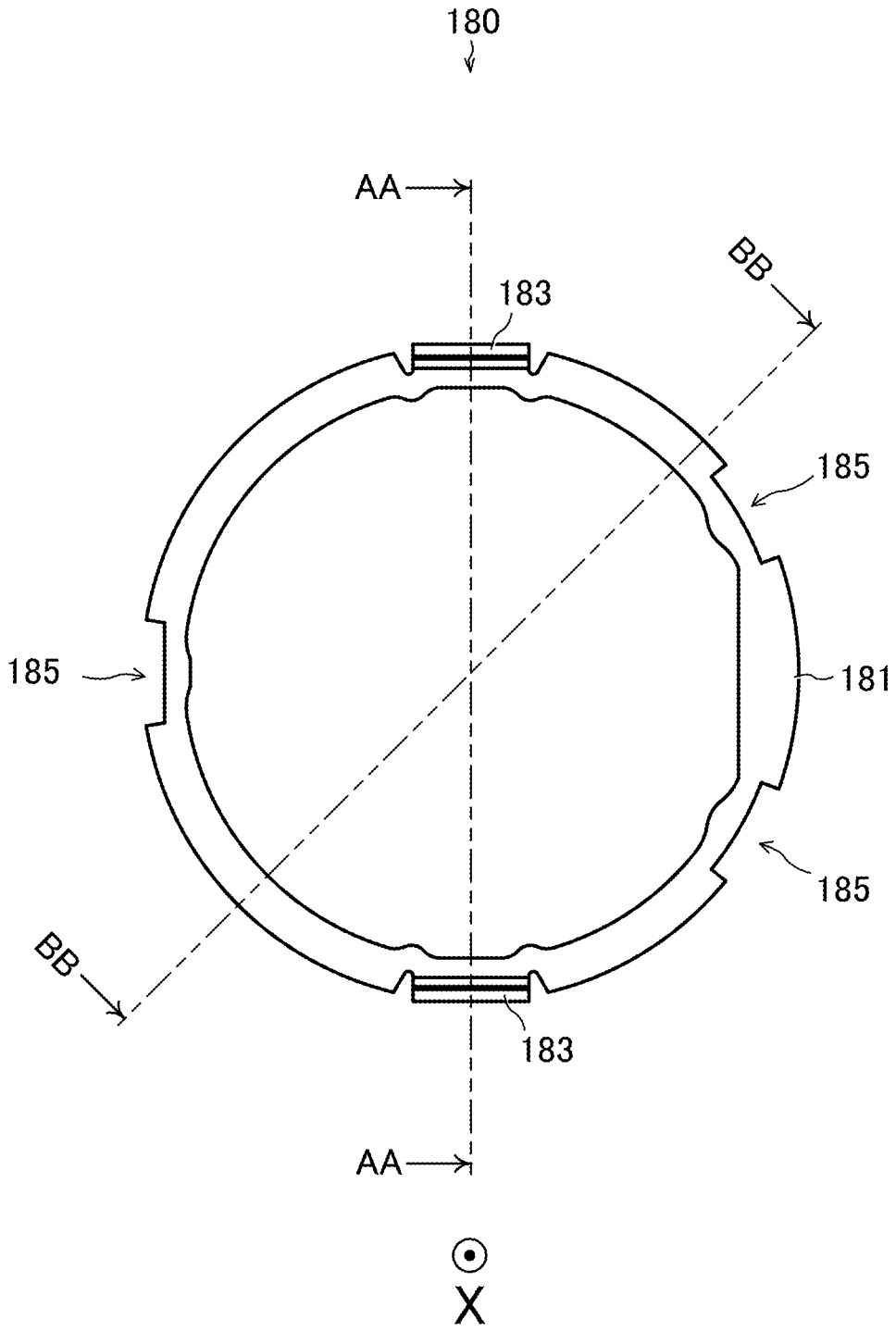
FIG. 5 is a front view of a locking member of the plug.

As illustrated in FIG. 5, the outer circumference of the ring 181 of the locking member 180 of the plug has recesses 185 recessed inward in the radial direction of the ring 181. The outer circumference of the ring 181 has a plurality of recesses 185, in specific, three recesses 185 spaced from each other in the circumferential direction about the virtual central axis parallel to the X axis, like the three linear ridges 153 of the releasing member 150 illustrated in FIGS. 4A and 4B.

These recesses 185 fit with the respective linear ridges 153 of the releasing member 150 illustrated in FIGS. 4A and 4B. The locking member 180 of the plug thus guides the sliding movement of the releasing member 150 in the positive and negative X-axis directions while preventing the releasing member 150 from revolving about the virtual central axis parallel to the X axis. During the sliding movement of the releasing member 150 in the X-axis directions relative to the locking member 180 of the plug, the linear ridges 153 of the releasing member 150 slide on the respective recesses 185 of the locking member 180 of the plug.

The locking member 180 of the plug also prevents the releasing member 150 from slipping out in the positive X-axis direction. This function will now be described with reference to FIG. 6, which is a cross-sectional view of the plug connector 100 taken along the line BB-BB of FIG. 5.

Figure 6:
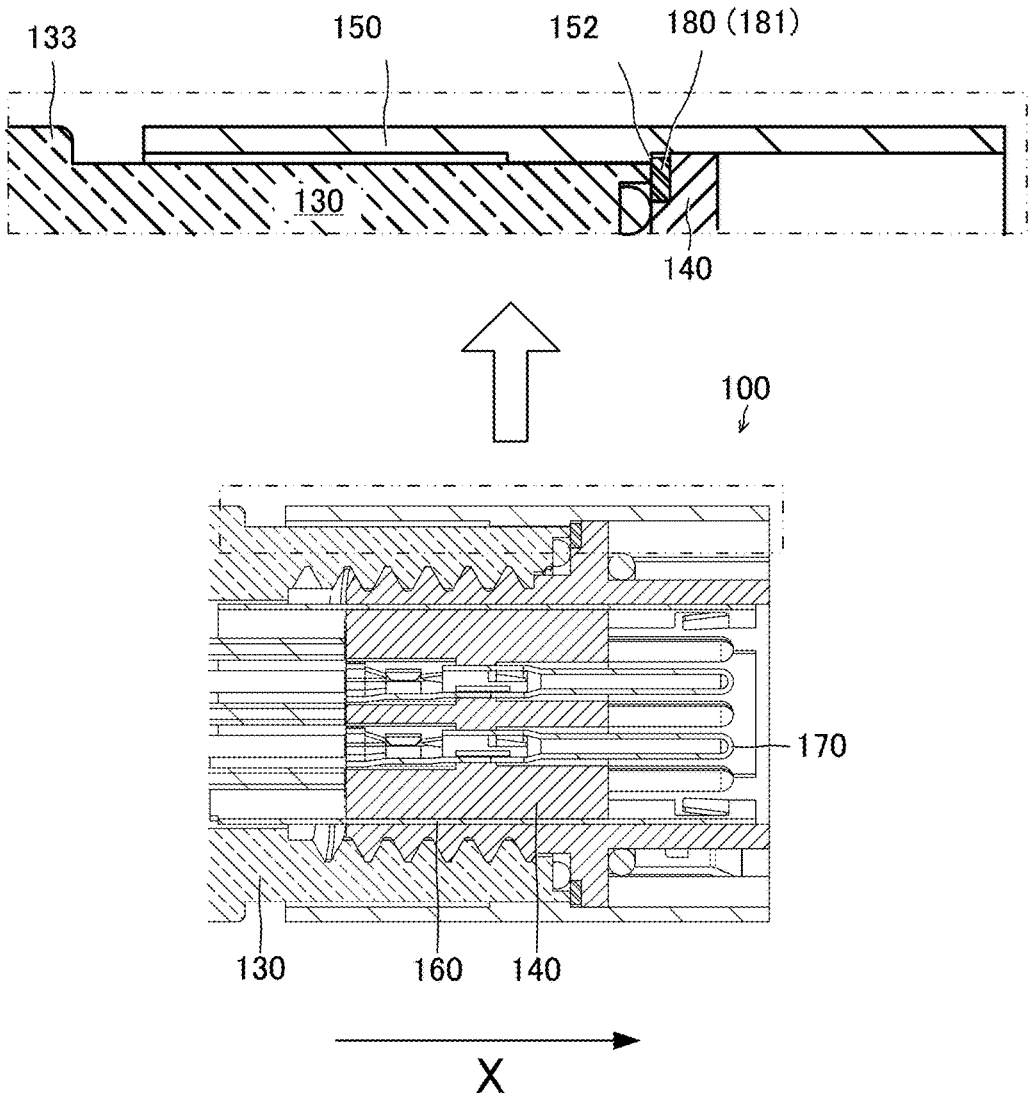
FIG. 6 is a cross-sectional view of the main part of the plug connector taken along the line BB-BB of FIG. 5.

As illustrated in the enlarged part of FIG. 6, if the releasing member 150 is displaced from the flange 133 in the positive X-axis direction by a predetermined distance relative to the first plug housing 130, the locking member 180 of the plug, and the second plug housing 140, then the step 152 (see FIGS. 4A and 4B) comes into contact with the periphery of the ring 181 of the locking member 180 of the plug. This configuration prevents the releasing member 150 from being displaced further than the predetermined distance in the positive X-axis direction.

That is, the periphery of the ring 181 of the locking member 180 of the plug, other than the portions adjoining the respective extension bases 182 illustrated in FIG. 3, serves as a blocker for preventing the releasing member 150 from slipping out in the positive X-axis direction.

In contrast, a displacement of the releasing member 150 in the negative X-axis direction is restricted by the flange 133 of the first plug housing 130 as described above. In other words, the releasing member 150 is coupled to the first plug housing 130 and the second plug housing 140 such that the releasing member 150 can slide in the positive and negative X-axis directions between the flange 133 and the ring 181.

The locking member 180 of the plug also urges the releasing member 150 in the positive X-axis direction. This function will now be described with reference to FIG. 7A, which is a cross-sectional view of the electrical connector pair 300 taken along the line AA-AA of FIG. 5.

Figure 7A:
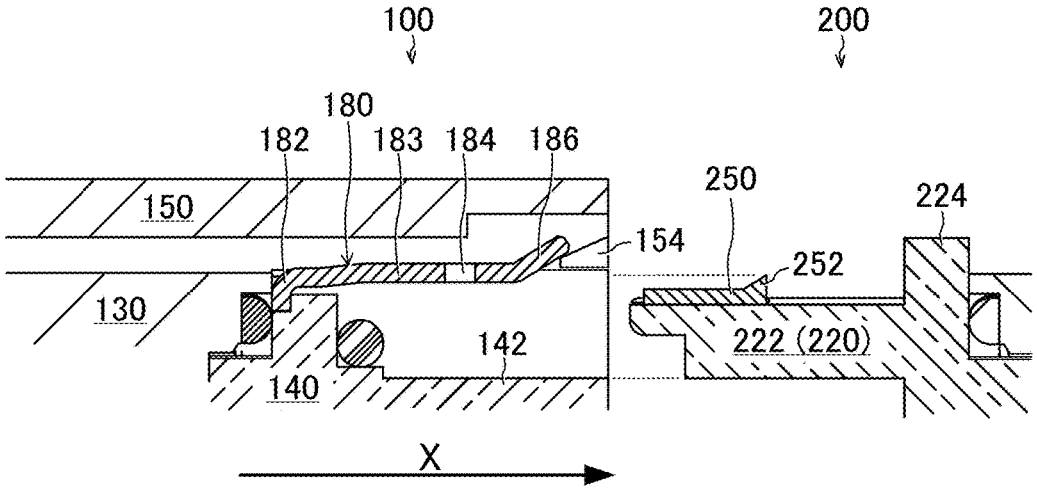
FIG. 7A is an enlarged partial cross-sectional view of the main part of the electrical connector pair taken along the line AA-AA of FIG. 5.

As illustrated in FIG. 7A, the cantilever extensions 183 of the locking member 180 of the plug each have an inclined portion 186 at the free end of the cantilever extension 183. The inclined portion 186 is inclined such that the inclined portion 186 recedes from the insertable portion 142 of the second plug housing 140 in the positive X-axis direction, that is, inclined outward in the radial direction of the insertable portion 142.

In contrast, the releasing member 150 has wedges 154 to come into contact with the respective inclined portions 186. The wedges 154 are each inclined such that the wedge 154 approaches the insertable portion 142 of the second plug housing 140 in the negative X-axis direction, that is, inclined inward in the radial direction of the insertable portion 142.

The releasing member 150 has two wedges 154 spaced from each other at an interval of 180° in the circumferential direction as illustrated in FIGS. 4A and 4B, in accordance with the two cantilever extensions 183 spaced from each other at an interval of 180° in the circumferential direction as illustrated in FIG. 3.

Referring back to FIG. 7A, under a normal condition where the releasing member 150 is not operated by the user, the wedges 154 each slightly push the corresponding inclined portion 186 in the direction receding from the insertable portion 142. In contrast, the cantilever extensions 183 each apply a resilient restoring force in the direction approaching the insertable portion 142 to the corresponding wedge 154 via the inclined portion 186. The cantilever extensions 183 thus urge the releasing member 150 in the positive X-axis direction.

In this configuration, the step 152 of the releasing member 150 abuts on the ring 181 of the locking member 180 of the plug, as illustrated in FIG. 6 (a cross-sectional view taken along the line BB-BB of FIG. 5). The ring 181 thus prevents the releasing member 150 from slipping out in the positive X-axis direction, which is urged by the cantilever extensions 183 as illustrated in FIG. 7A (a cross-sectional view taken along the line AA-AA of FIG. 5) in the positive X-axis direction.

That is, the locking member 180 of the plug restricts the displacement of the releasing member 150 in the positive X-axis direction at the ring 181 and urges the releasing member 150 in the positive X-axis direction at the cantilever extensions 183. Accordingly, under the normal condition, the position of the releasing member 150 in the X-axis direction relative to the first plug housing 130 and the second plug housing 140 is stabilized in the position (hereinafter referred to as "neutral position") illustrated in FIG. 7A or 6, where the step 152 abuts on the ring 181.

As is apparent from the above description and FIG. 3, the releasing member 150 and the locking member 180 of the plug, of which the inclined portions 186 abut on the respective wedges 154 and the ring 181 is disposed more adjacent to the second plug housing 140 than the step 152 as illustrated in FIG. 6, are disposed between the first plug housing 130 and the second plug housing 140. The releasing member 150 is thus slidably coupled to the first plug housing 130 and the second plug housing 140.

The following explanation will focus on the operation of the electrical connector pair 300 during the plugging and unplugging operations of the plug connector 100 into and from the receptacle connector 200.

With reference to FIG. 7A, the plug connector 100 is aligned to an appropriate position relative to the receptacle housing 220 in a virtual plane orthogonal to the X axis and then plugged into the receptacle connector 200 such that the outer circumference of the insertable portion 142 slides on the inner circumference of the outer cylinder 222 of the receptacle housing 220.

Here a height direction is defined by the radially outward direction of the insertable portion 142 from the outer circumference of the insertable portion 142. The entire releasing member 150 including each wedge 154 is disposed higher than the top of the corresponding protrusion 252. The releasing member 150 therefore allows the protrusion 252 to relatively move in the positive and negative X-axis directions. That is, the releasing member 150 does not come into contact with the protrusion 252 during the plugging operation of the plug connector 100 aligned to the appropriate position in the virtual plane orthogonal to the X axis into the receptacle connector 200.

In contrast, the inner surface of each cantilever extension 183 facing the outer circumference of the insertable portion 142 is lower than the top of the corresponding protrusion 252. The protrusion 252 therefore comes into contact with the corresponding inclined portion 186 during the plugging operation of the plug connector 100 into the receptacle connector 200. Further insertion of the plug connector 100 causes the protrusion 252 to push up the cantilever extension 183 in the direction receding from the insertable portion 142.

The front surface of each protrusion 252 to face the corresponding inclined portion 186 during the plugging operation of the plug connector 100 is inclined such that the height of the front surface increases along the positive X-axis direction. The inclined portion 186 is thus smoothly pushed up by the protrusion 252.

Figure 7B:
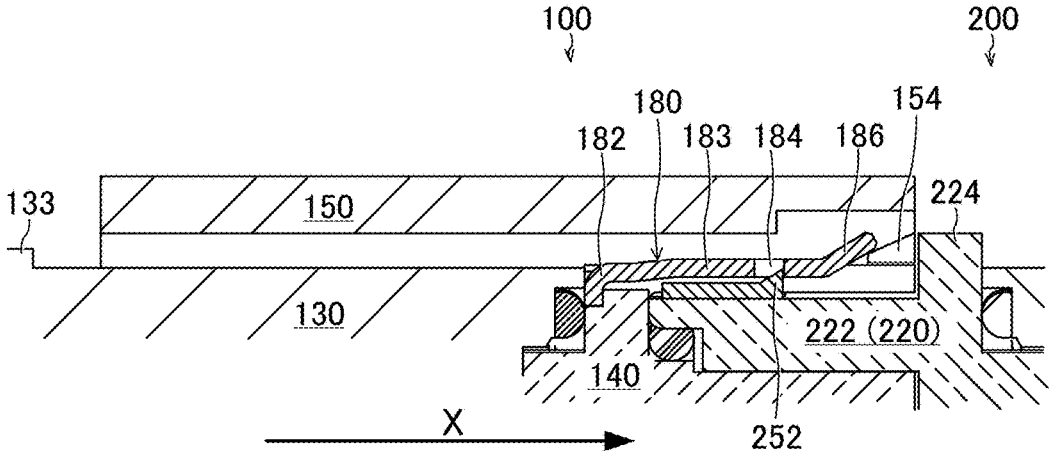
FIG. 7B is an enlarged partial cross-sectional view of the main part of the electrical connector pair taken along the line AA-AA of FIG. 5.

With reference to FIG. 7B, upon completion of the plugging operation of the plug connector 100, each protrusion 252 fits in the corresponding engaged hole 184 and each cantilever extension 183 returns to the initial position before being pushed up by the protrusion 252. This configuration prevents the plug connector 100 from being unplugged from the receptacle connector 200.

The protrusions 252 each have an upright rear surface adjacent to the flange 224. In specific, the rear surface of the protrusion 252 is substantially parallel to a virtual plane orthogonal to the X axis. The inner surface of the corresponding engaged hole 184 to come into contact with the rear surface of the protrusion 252 is also substantially parallel to this virtual plane. This configuration rarely causes slipping between the protrusion 252 and the engaged hole 184 in response to a force for unplugging the plug connector 100 without the sliding movement of the releasing member 150, thereby increasing the effects of preventing the unplugging operation of the plug connector 100.

The unplugging operation of the plug connector 100 requires the preceding release of each protrusion 252 from the corresponding engaged hole 184. The user therefore slides the releasing member 150 from the neutral position illustrated in FIG. 7B in the negative X-axis direction.

Figure 7C:
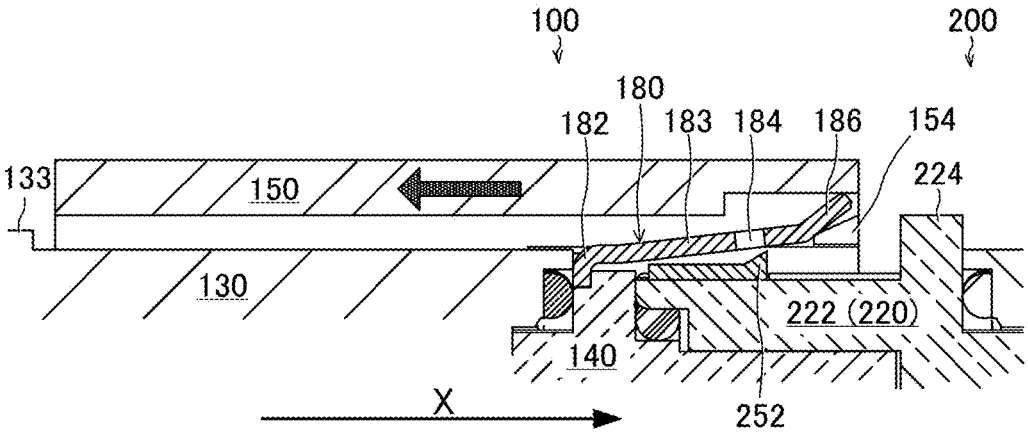
FIG. 7C is an enlarged partial cross-sectional view of the main part of the electrical connector pair taken along the line AA-AA of FIG. 5.

With reference to FIG. 7C, in response to the sliding movement of the releasing member 150 in the negative X-axis direction, that is, in response to the sliding movement of each wedge 154 in the negative X-axis direction against the resilient restoring force applied by the corresponding cantilever extension 183 in the direction approaching the outer cylinder 222, the wedge 154 pushes up the inclined portion 186 in the direction receding from the outer cylinder 222. This operation bends the cantilever extension 183 upward in the height direction of the protrusion 252, thereby releasing the engagement of the protrusion 252 with the engaged hole 184.

The user can thus unplug the plug connector 100 from the receptacle connector 200 while applying a force for sliding the releasing member 150 in the negative X-axis direction as illustrated in FIG. 7C. After the unplugging operation of the plug connector 100, when the user stops applying the force for sliding the releasing member 150 in the negative X-axis direction, the resilient restoring force applied by each cantilever extension 183 returns the releasing member 150 to the neutral position as illustrated in FIG. 7A.

As described above, the engagement of the protrusions 252 of the receptacle connector 200 with the respective engaged holes 184 of the cantilever extensions 183 maintains the plug connector 100 according to the embodiment to be plugged in the receptacle connector 200.

The installation of the cantilever extensions 183 having the engaged holes 184 requires a smaller space between the second plug housing 140 and the releasing member 150 than the space required for the installation of a member having a hook-shaped and expanding cross section in the traditional plug connector. The size of the plug connector 100 can therefore be reduced in comparison to the traditional plug connector.

The locking member 180 of the plug of the plug connector 100 not only engages with the locking member 250 of the receptacle, but also guides the sliding movement of the releasing member 150, prevents the releasing member 150 from slipping out in the positive X-axis direction, and urges the releasing member 150 in the positive X-axis direction. This configuration can reduce the number of components and simplify the structures of the components, thereby reducing the size of the plug connector 100 in comparison to the traditional plug connector.

As well as the cantilever extensions 183 of the plug connector 100, the protrusions 252 of the receptacle connector 200 are made of a metal and thus have a longer service life than resin protrusions. The metal protrusions 252 in the receptacle connector 200 are installed by fitting the locking member 250 of the receptacle having the protrusions 252 into the circumferential groove 222*a* and the intersecting grooves 222*b* of the receptacle housing 220. This configuration can prevent an increase in the radial size of the receptacle connector 200 despite of the metal protrusions 252.

The above embodiment of the present disclosure should not be construed to limit the disclosure. For example, the embodiment may be modified as described below.

Although the plugged state of the plug connector 100 in the receptacle connector 200 is maintained by the engagement of the protrusions 252 with the engaged holes 184 in the above embodiment, the plugged state may be maintained by the engagement of engaging portions disposed in the receptacle connector 200 with engaged portions disposed in the respective cantilever extensions 183 of the plug connector 100, in place of the protrusions 252 and the engaged holes 184. As long as the locking member 180 of the plug has functions such as a function for preventing the releasing member 150 from slipping out, the size of the plug connector 100 can be reduced in comparison to the traditional plug connector without the combination of the protrusions 252 and the engaged holes 184.

In place of the recesses 185 on the ring 181 of the locking member 180 of the plug and the linear ridges 153 on the inner circumference of the releasing member 150 to fit in the recesses 185 in the above embodiment, the ring 181 of the locking member 180 of the plug may have protrusions protruding outward in the radial direction of the ring 181 and the inner circumference of the releasing member 150 may have linear grooves to fit with the respective protrusions. That is, the locking member 180 of the plug is only required to have a shape for guiding the releasing member 150 in the X-axis direction while restricting the revolution of the releasing member 150 about the virtual central axis parallel to the X axis.

Although the plug connector 100 and the receptacle connector 200 are circular connectors each having a substantially circular contour as viewed in the direction parallel to the X axis in the above embodiment, the plug connector 100 and the receptacle connector 200 may have any other contour. For example, the plug connector 100 and the receptacle connector 200 may be rectangular connectors each having a substantially quadrangular contour as viewed in the direction parallel to the X axis.

The foregoing describes some example embodiments for explanatory purposes. Although the foregoing discussion has presented specific embodiments, persons skilled in the art will recognize that changes may be made in form and detail without departing from the broader spirit and scope of the present disclosure. Accordingly, the specification and drawings are to be regarded in an illustrative rather than a restrictive sense. This detailed description, therefore, is not to be taken in a limiting sense, and the scope of the present disclosure is defined only by the included claims, along with the full range of equivalents to which such claims are entitled.

What is claimed is:

1. An electrical connector assembly comprising:

a housing having insulating properties and shaped so as to be plugged into and unplugged from a mating housing included in a mating electrical connector;

contacts retained in the housing, the contacts being electrically connected to respective mating contacts retained in the mating housing of the mating electrical connector while the housing is being plugged in the mating housing;

a locking member comprising:

extension bases fixed to the housing; and cantilever extensions extending from the respective extension bases in a direction of a plugging operation, the cantilever extensions each comprising an engaged hole to receive corresponding one of protrusions protruded from the mating housing and configured to engage with the respective engaged holes upon completion of the plugging operation, the cantilever extensions being each resilient enough to bend in a protruding direction of the corresponding protrusion; and a releasing member coupled to the housing such that the releasing member is slidable in the direction of the plugging operation and a direction of an unplugging operation, the releasing member being configured to allow the protrusions to relatively move in the directions of the plugging and unplugging operations, the releasing member being configured to bend the cantilever extensions in the protruding directions of the respective protrusions and thereby release engagement of the protrusions with the engaged holes when the releasing member is slid relative to the housing, wherein the locking member further comprises a blocker integrated with the extension bases and fixed to the housing while extending along an outer circumference of the housing in a virtual plane orthogonal to the directions of the plugging and unplugging operations, the blocker being configured to prevent the releasing member from slipping out of the housing in the direction of the plugging operation at blocking portions of the blocker other than portions adjoining the respective extension bases.

2. The electrical connector assembly according to claim 1, wherein the cantilever extensions urge the releasing member in the direction of the plugging operation, and the blocker prevents the releasing member urged by the cantilever extensions in the direction of the plugging operation from slipping out in the direction of the plugging operation.

3. The electrical connector assembly according to claim 1, wherein the cantilever extensions each comprise an inclined portion at a free end of the cantilever extension, the inclined portion being inclined such that the inclined portion recedes from the housing in the direction of the plugging operation, the releasing member comprises wedges to come into contact with the respective inclined portions, the wedges being each inclined such that the wedge approaches the housing in the direction of the unplugging operation, the cantilever extensions each urge the releasing member in the direction of the plugging operation by applying a resilient restoring force in a direction approaching the housing to the corresponding wedge via the inclined portion, and when each of the wedges is slid in the direction of the unplugging operation against the resilient restoring force, the wedge pushes the corresponding inclined portions in a direction receding from the housing and thereby bends the cantilever extension in the protruding direction of the corresponding protrusion.

4. An electrical connector assembly comprising:

a housing having insulating properties and shaped so as to be plugged into and unplugged from a mating housing included in a mating electrical connector;

contacts retained in the housing, the contacts being electrically connected to respective mating contacts retained in the mating housing of the mating electrical connector while the housing is being plugged in the mating housing;

a locking member comprising:

extension bases fixed to the housing; and cantilever extensions extending from the respective extension bases in a direction of a plugging operation, the cantilever extensions each comprising an engaged portion to receive corresponding one of engaging portions disposed in the mating housing and configured to engage with the respective engaged portions upon completion of the plugging operation, the cantilever extensions being each resilient enough to bend in a direction receding from the housing; and a releasing member coupled to the housing such that the releasing member is slidable in the direction of the plugging operation and a direction of an unplugging operation, the releasing member being configured to allow the engaging portions to relatively move in the directions of the plugging and unplugging operations, the releasing member being configured to bend the cantilever extensions in the directions receding from the housing and thereby release engagement of the engaging portions with the engaged portions when the releasing member is slid relative to the housing, wherein the locking member further comprises a blocker integrated with the extension bases and fixed to the housing while extending along an outer circumference of the housing in a virtual plane orthogonal to the directions of the plugging and unplugging operations, the blocker being configured to prevent the releasing member from slipping out of the housing in the direction of the plugging operation at blocking portions of the blocker other than portions adjoining the respective extension bases.

5. An electrical connector assembly pair comprising:

a mating electrical connector; and, an electrical connector assembly, the electrical connector assembly including:

a housing having insulating properties and shaped so as to be plugged into and unplugged from a mating housing included in the mating electrical connector, contacts retained in the housing, the contacts being electrically connected to respective mating contacts retained in the mating housing of the mating electrical connector while the housing is being plugged in the mating housing, a locking member comprising extension bases fixed to the housing, and cantilever extensions extending from the respective extension bases in a direction of a plugging operation, the cantilever extensions each comprising an engaged hole to receive corresponding one of protrusions protruded from the mating housing and configured to engage with the respective engaged holes upon completion of the plugging operation, the cantilever extensions being each resilient enough to bend in a protruding direction of the corresponding protrusion, and a releasing member coupled to the housing such that the releasing member is slidable in the direction of the plugging operation and a direction of an unplugging operation, the releasing member being configured to allow the protrusions to relatively move in the directions of the plugging and unplugging operations, the releasing member being configured to bend the cantilever extensions in the protruding directions of the respective protrusions and thereby release engagement of the protrusions with the engaged holes when the releasing member is slid relative to the housing, wherein the locking member further comprises a blocker integrated with the extension bases and fixed to the housing while extending along an outer circumference of the housing in a virtual plane orthogonal to the directions of the plugging and unplugging operations, the blocker being configured to prevent the releasing member from slipping out of the housing in the direction of the plugging operation at blocking portions of the blocker other than portions adjoining the respective extension bases.

6. The electrical connector assembly pair according to claim 5, wherein the mating electrical connector comprises an installing member mounted around the mating housing in a virtual plane orthogonal to the directions of the plugging and unplugging operations, the protrusions being disposed on the installing member.

7. The electrical connector assembly pair according to claim 5, the protrusions are each inclined such that a height of the protrusion increases along the direction of the plugging operation.

* * * * *